US008024827B2

(12) United States Patent
Ricketts

(10) Patent No.: US 8,024,827 B2
(45) Date of Patent: Sep. 27, 2011

(54) PATIENT RESCUE BAG METHOD

(76) Inventor: Robert A. Ricketts, Polson, MT (US)

( * ) Notice: Subject to any disclaimer, the term of this patent is extended or adjusted under 35 U.S.C. 154(b) by 0 days.

(21) Appl. No.: 13/041,987

(22) Filed: Mar. 7, 2011

(65) Prior Publication Data

US 2011/0185498 A1 Aug. 4, 2011

Related U.S. Application Data

(62) Division of application No. 11/343,438, filed on Jan. 31, 2006.

(51) Int. Cl.
*A61G 7/10* (2006.01)

(52) U.S. Cl. ..... 5/625; 5/627; 5/628; 5/413; 5/484

(58) Field of Classification Search ..... 5/625–628, 5/89.1, 413, 484–486, 494, 502; 2/69.5
See application file for complete search history.

(56) References Cited

U.S. PATENT DOCUMENTS

2008/0021530 A1* 1/2008 Castellani et al. ..... 607/108
* cited by examiner

*Primary Examiner* — Fredrick Conley
(74) *Attorney, Agent, or Firm* — Wood, Herron & Evans, LLP

(57) ABSTRACT

Provided is a method for using a patient rescue bag, particularly for extreme wet weather use. A substantially rectangular upper portion is sized wider than a substantially rectangular lower portion such that longitudinal edges of the upper portion are folded downwardly and inwardly so that an inner layer of the upper portion is releasably attached to an outer layer of the lower portion. A patient is placed within the patient rescue bag such that the patient rests upon the lower portion and the upper portion is above the patient. The longitudinal edges of the upper portion are folded downwardly and inwardly to extend under the longitudinal edges of the lower portion. In this manner, the exposed edges of the connection between upper and lower portions are not subject to accumulated rain or snow seeping into the patient chamber or being forced in by helicopter downdraft.

9 Claims, 4 Drawing Sheets

PATIENT RESCUE BAG METHOD

RELATED APPLICATION

This application is a divisional and claims the benefit of U.S. patent application Ser. No. 11/343,438 filed Jan. 31, 2006.

TECHNICAL FIELD

This invention relates to an improved piece of safety and rescue equipment for keeping a person warm, dry and comfortable after the person has been injured and must be removed from a location that is remote from normal transportation routes. More specifically, the invention provides a design that is better suited for use during extreme wet condition and is resistant to helicopter rotor downdrafts.

BACKGROUND

When a person is injured in a remote location, rescue workers often are required to hand carry the person on a stretcher to a location where an ambulance or helicopter can be reached. This is particularly true in remote locations consisting of rough terrain such as mountains, and in such circumstances the injured person would be exposed to the elements until the emergency rescue vehicle could be reached. A patient rescue bag for this purpose is described in my prior U.S. Pat. No. 5,386,604, issued Feb. 7, 1995, the contents of which are hereby incorporated by reference. Since that time, rescue bags of this design have been put to use in increasingly hostile environments, such as by the military. In these situations, an injured person may have to be held at one location for a significant period of time during wet weather until it is safe for a transport vehicle to arrive on the scene. They may also be more likely, in these situations, to be held close to an evacuation helicopter's landing place directly below the propeller downdraft and to be present during the helicopter's landing.

Referring to FIG. 1, therein is schematically shown a cross-sectional view of a prior art design of a patient rescue bag commonly in use by civilian rescue and evacuation teams. This design, as shown in my above-referenced prior patent, keeps the patient warm while providing access to any part of the patient's body around any part of the perimeter of the rescue bag. However, if it is necessary for the patient to remain exposed to wet weather conditions, precipitation (rain or snow) falling onto the upper layer can seep into the interior of the bag through the quick connect/disconnect fastener devices along the longitudinal edges of the bag. This problem can be exacerbated when the patient is exposed to the extremely powerful downdraft of a military rescue helicopter.

While my prior design is acceptable for most civilian applications, a new design addressing specific shortcomings for military or extreme wet weather situations was needed. Subsequent designs by others have not, heretofore, filled this need.

SUMMARY OF THE INVENTION

The present invention provides an improved patient rescue bag comprising generally rectangular upper and lower portions sized to receive a supine person there between. Each of the upper and lower portions have an outer surface, and interior surface, and an inner portion there between which includes thermal insulative material. The upper portion has a width greater than that of the lower portion such that longitudinal edges of the upper portion are folded downwardly and inwardly to extend under longitudinal edges of the lower portion. In this manner, rain or melting snow accumulating on the outside of the upper portion will be shed to the ground without seeping into the interior of the rescue bag. Likewise, intense downdraft from a helicopter rotor does not drive accumulated rain or snow into the interior of the bag through the peripheral access seams.

BRIEF DESCRIPTION OF THE DRAWINGS

Like reference numerals are used to indicate like parts throughout the various figures of the drawing, wherein.

DETAILED DESCRIPTION OF THE INVENTION

Figure 3:
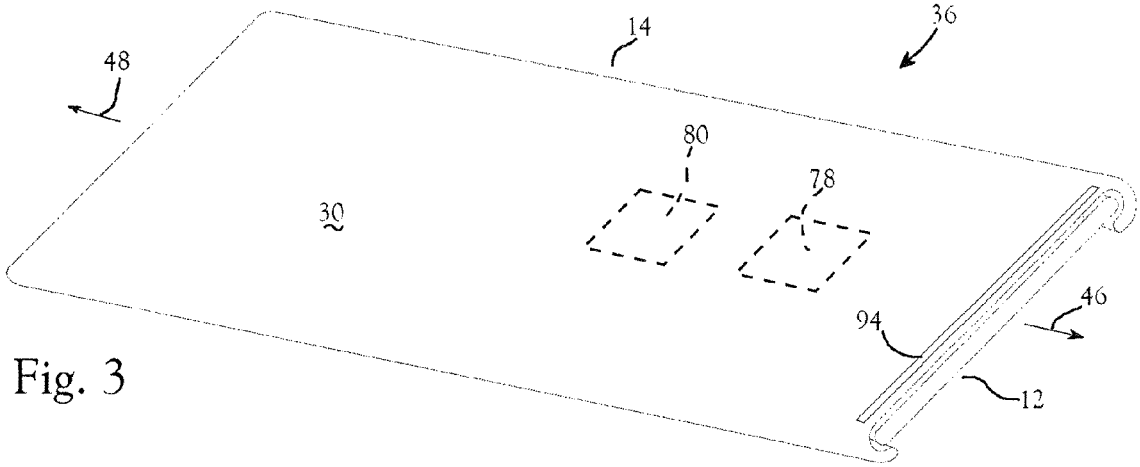
FIG. 3 is a pictorial view of the present invention.

This invention represents an improvement over the patient rescue bag described in my prior U.S. Pat. No. 5,386,604, issued Feb. 7, 1995, the content of which is fully incorporated herein by reference. A cross sectional view of the prior device 10' is shown schematically in FIG. 1. In the prior version, the lower portion 12' of the bag has a width greater than the upper portion 14'. Longitudinal edges 16, 18 of the lower portion 12' are folded upwardly and inwardly to be secured to an outer surface of the upper portion 14'. The device 10' provides a self-contained bedding system designed to provide patient access around its entire perimeter, while maintaining patient body temperature. This design 10' remains adequate for most emergency medical transport situations. However, there are situations (military, in particular) where a patient being evacuated must be held for an extended period of time in extreme wet conditions. Rain or melted snow (schematically illustrated by arrows 20) that falls onto the upper portion can eventually seep through the fastener devices 22 (usually strips of hook and loop fastener material, such as VELCRO®) to the interior 24 of the bag 10' where the patient (not shown) is situated.

Additionally, this problem can be exacerbated by the extraordinarily strong downdraft of a helicopter rotor when the patient must be held very close to the helicopter landing area. The downdraft will act to force rain water or melted snow 20 through the fastener connections.

The prior design possesses certain advantages in ordinary, civilian applications. The peripheral edges 16, 18 are easier visually to locate and selectively open for patient access when they are on the top surface of the upper portion and lost bodily fluids of the patient may be better contained. These advantages are outweighed by different concerns in other situations, however.

Figure 1:
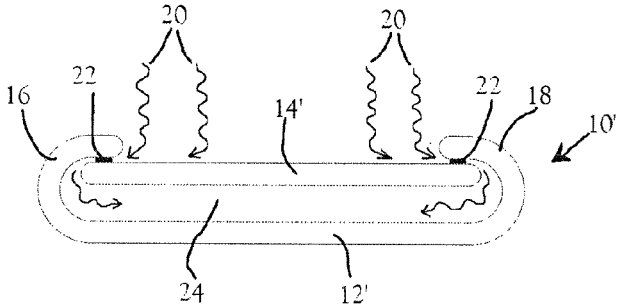
Fig. 1 (PRIOR ART)
FIG. 1 is a schematic cross-sectional view of a prior art patient rescue bag construction.
Figure 2:
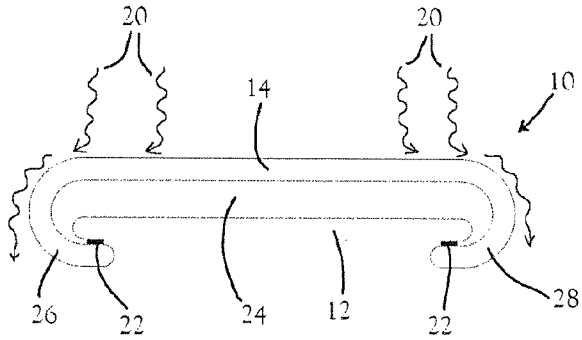
FIG. 2 is a similar schematic cross-sectional view of a bag according to an embodiment of the present invention.

Referring now to FIG. 2, therein is schematically shown a cross-sectional view similar to that of FIG. 1, but of an improved construction of a patient rescue bag 10. In the improved embodiment, the upper portion 14 is wider than the lower portion 12 and the longitudinal edges 26, 28 are wrapped downwardly and inwardly for connection to the underside of the lower portion 12. Rain or snow 20 that falls on the outer surface of the upper portion 14 is shed off of the bag 10 without seeping or being driven into the interior 24 through the fasteners 22.

Referring now to FIGS. 3-8, therein is shown a patient rescue bag generally indicated at 10. Patient rescue bag 10 largely comprises an lower portion 12 and upper portion 14, of which upper portion 14 includes a top outer layer 30, which can have various attachments such as are discussed in my above-identified prior patent, and which is preferably sewn or glued to a top inner layer 32. Top outer layer 30 and top inner layer 32 have generally rectangular perimeters and preferably are made to substantially the same length and width dimensions so that their longitudinal and transverse edges can be permanently attached together, respectively, at their perimeters when one layer is placed upon the other. A top insulative core 34 may be positioned between top outer layer 30 and top inner layer 32. The edges of these two layers are preferably sewn together along three of their four edges, however, a permanent glue could be used as an alternative method of their attachment to one another.

Top outer layer 30 is preferably removably attached to top inner layer 32 along their fourth edge so that access is available to the inner space between these two layers. A transverse strip (not shown) of a hook and loop fastener material, such as VELCRO®, is preferably attached to the inner surface of top inner layer 32, and is made of either male or female VELCRO®. A mating strip (also not shown) of VELCRO® is also attached to the inner surface of top outer layer 30 so that, when these two VELCRO® strips are engaged together, the fourth edge is mechanically closed. This closure construction is shown in my prior patent and is not an essential part of the present invention.

Top outer layer 30 and top inner layer 32 are preferably constructed of a waterproof, flexible material. One appropriate material for such use is STORM-TECH™ manufactured by Brookwood, located in Gardena, Calif. A preferred material for top insulative core 34 is down, however, it will be understood that any type of flexible thermal insulative material could be used in this application. Other exemplary materials for top insulative core 34 are cotton or a synthetic fiber such as PRIMALOFT™ (manufactured by Albany International).

A bottom outer layer 36 and a bottom inner layer 38 also have generally rectangular perimeters and preferably are made to substantially the same length and width dimensions so that their longitudinal and transverse edges can be permanently attached together, respectively, at their perimeters and around a bottom insulative core 40, similar to the top insulative core 34. Bottom outer and inner layers 36 and 38, respectively, are preferably made of a waterproof, flexible material such as STORM-TECH™.

Bottom insulative core 40 is positioned between bottom outer layer 36 and bottom inner layer 38. The edges of these two layers are preferably sewn together along three of the four edges, however, a permanent glue could be used as an alternative method of their attachment to one another. Bottom outer layer 36 is preferably removably attached to bottom inner layer 38 along the fourth edge so that access is available to the inner space between these two layers. As described above, a transverse strip (not shown) of a hook and loop fastener material, such as VELCRO®, is preferably attached to the inner surface of bottom inner layer 36 and is made of either male or female VELCRO®. A mating strip (not shown) of VELCRO® is also attached to the inner surface of bottom outer layer 36 so that, when these two VELCRO® strips are engaged together, the fourth edge is mechanically closed.

A disposable/replaceable adsorbent and liquid-proof liner may be used, as described in my prior patent. This feature is not shown herein in order to provide simplicity and clarity in illustrating the present invention.

Figure 4:
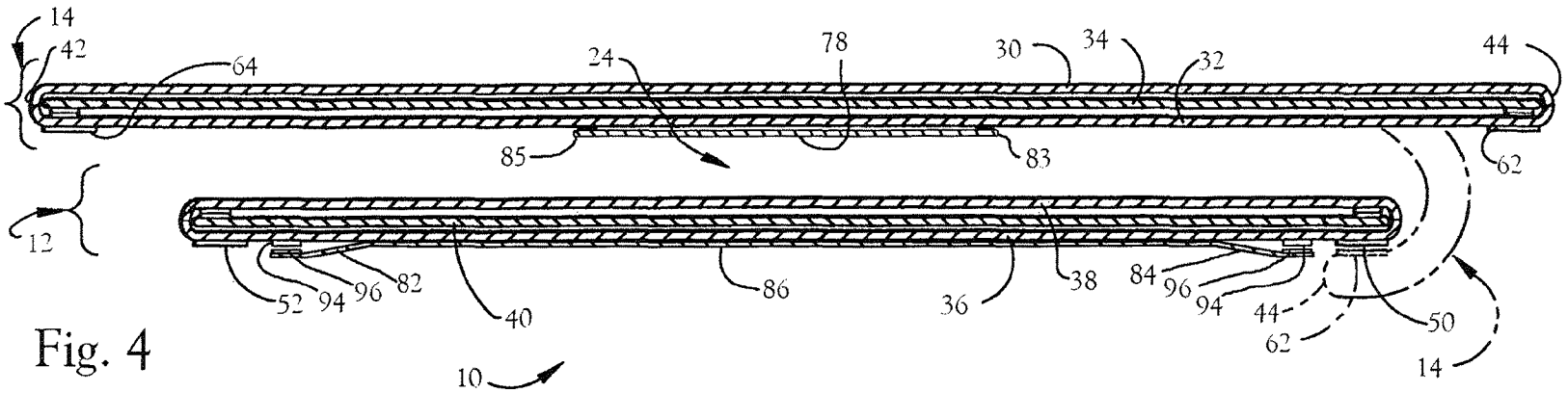
FIG. 4 is a cross-sectional view taken substantially along line 4-4 of FIG. 5.
Figure 6:
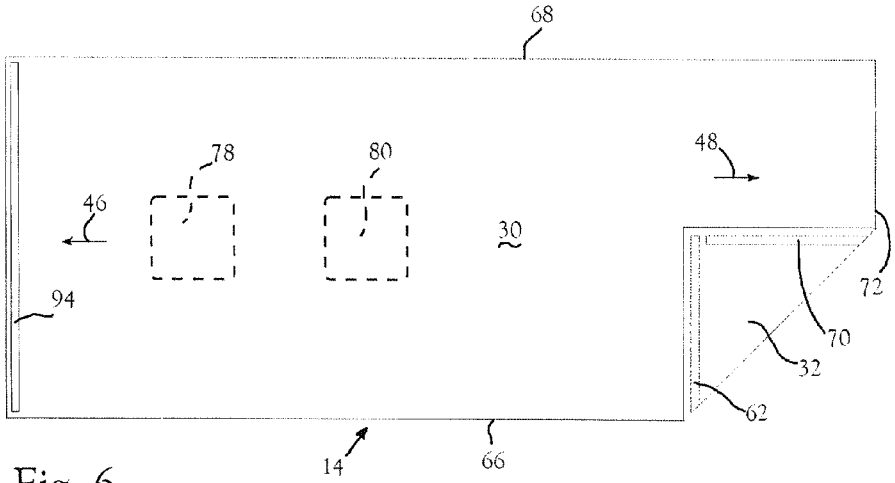
FIG. 6 is a plan view of the outside (top) of the upper portion.
Figure 5:
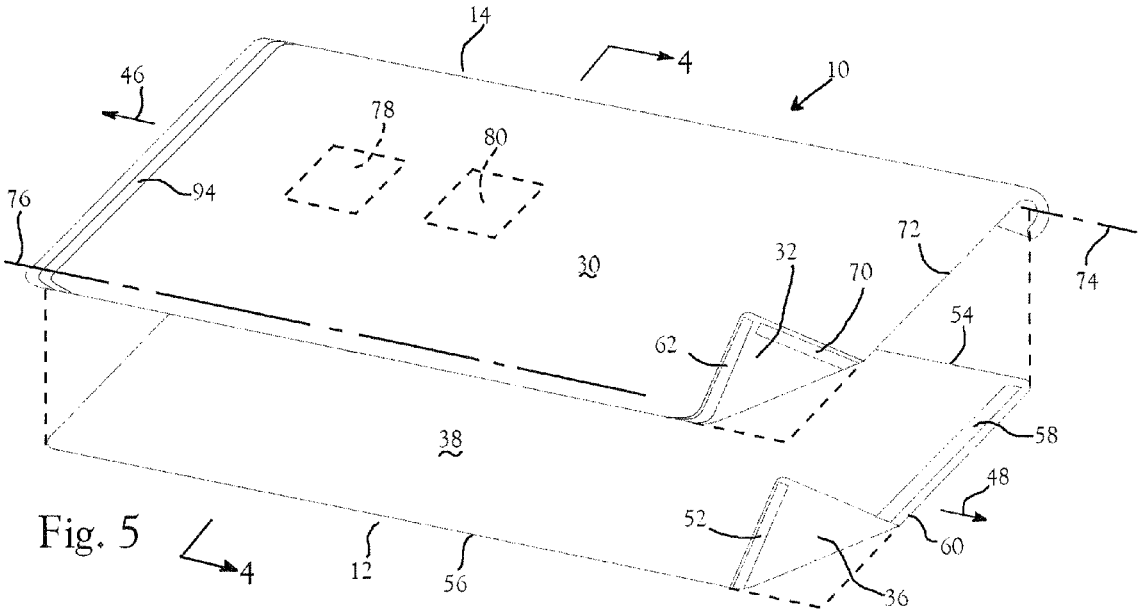
FIG. 5 is a pictorial view with the upper and lower portions separated.

As shown in FIGS. 2-5, the upper portion 14 is constructed to be wider in the transverse direction than the lower portion 12. As can be seen in FIGS. 3-5, upper portion 14 is flexible such that it can be folded or rolled near its longitudinal edges 42 and 44. With index numeral 46 representing the "head" direction of patient rescue bag 10 and index numeral 48 representing the "feet" direction of patient rescue bag 10 it can be seen that longitudinal edges 42 and 44 are parallel to the length of a patient's body as the patient occupies patient area 24. The attachment of upper portion 12 to lower portion 14 will be discussed in detail, below.

Figure 7:
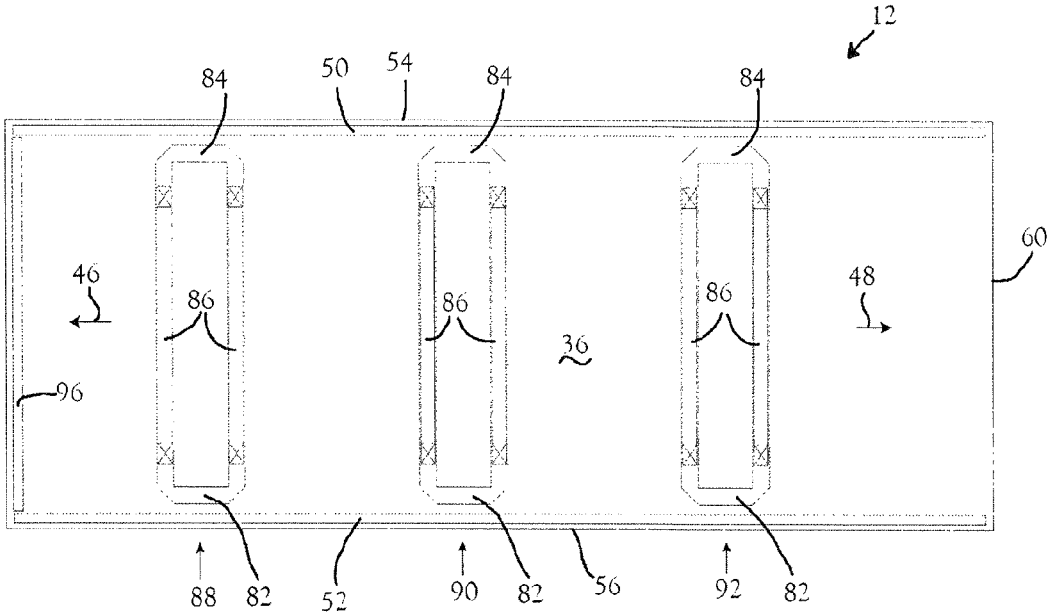
FIG. 7 is a plan view of the outside (bottom) of the lower portion.
Figure 8:
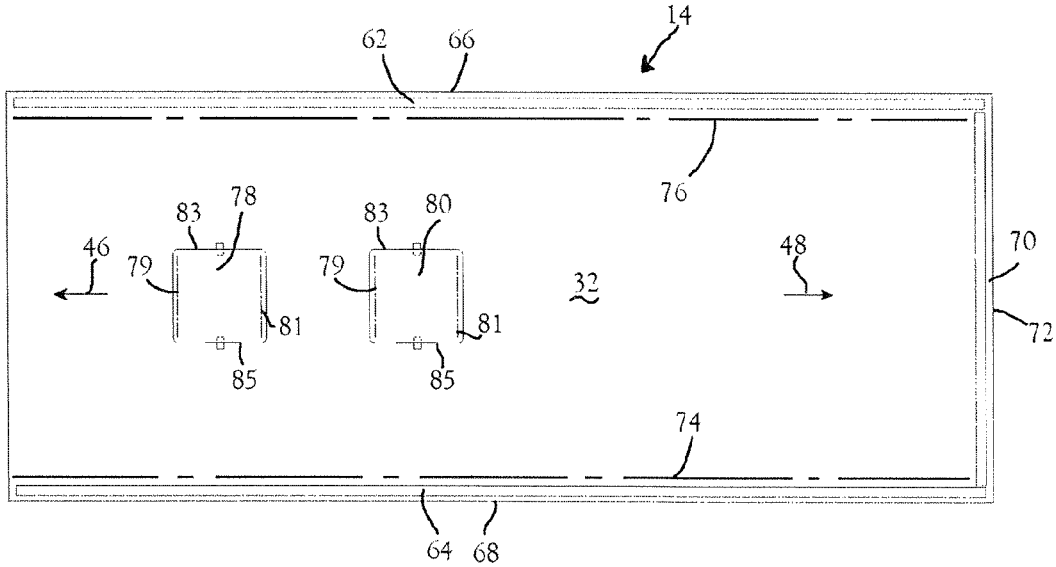
FIG. 8 is a plan view of the inside surface of the upper portion.

The lower surface of bottom outer layer 36 is depicted in FIG. 7 and preferably includes two long VELCRO® strips 50, 52 attached along the longitudinal edges 54, 56. The upper surface of the bottom inner layer 38 (see FIG. 5) includes a VELCRO® strip 58 positioned along the transverse edge 60 at the foot end 48. The lower surface of the upper inner layer 32 is depicted in FIG. 8 and preferably includes two long VELCRO® strips 62, 64 attached along the longitudinal edges 66, 68. These strips 62, 64 are complementary to the longitudinal strips 50, 52 on the lower portion 12. A third VELCRO® strip 70 is attached along the foot end 48 transverse edge 72 of the inner surface of the upper inner layer 32. This strip 70 is complementary to the transverse strip 58 at the foot end 48 on the lower portion 12. Reference to "complementary" strips of VELCRO® refer to the mating male/female or hook/loop components of any brand of this type of quick-release fastener systems. Other devices, such as a series of snaps, could also be employed for this purpose.

Once a patient has been placed upon the surface of bottom inner layer 38, upper portion 14 can be placed on top of the patient and VELCRO® strip 58 can be attached to VELCRO® strip 70 to close the area nearest the patient's feet.

As described above, upper portion 14 is wider than lower portion 12, and thus top inner layer 32 is wider than bottom inner layer 38 and bottom outer layer 36. Two longitudinal fold lines 74, 76 (FIGS. 5 and 8) are used to fold over the outer longitudinal edges 66 and 68 of top inner layer 32. With top inner layer 32 folded over along fold line 74, for example, as shown in FIGS. 4 and 5, VELCRO® strip 64 can then attach to complementary VELCRO® strip 52. In a similar manner, VELCRO® strip 62 can be folded over, along fold line 76, and attached to VELCRO® strip 50.

As described above, the use of VELCRO® strips 50, 52 (and their mating VELCRO® strips 62, 64) along the longitudinal edges as well as the mating VELCRO® strips 58, 70 along transverse edges 60, 72 provide a means for releasably securing upper portion 14 to lower portion 12. In addition, such releasably securing means allows access to a patient occupying patient area 24 from any direction (i.e., from any location) along all edges without disturbing any other parts of the releasably securing means (i.e., along other portions of the VELCRO® strips). Other types of releasably securing means could alternatively be used in lieu of VELCRO®, however, a standard zipper may not provide such instantaneous access to a mid-portion of one of the edges without disturbing the remaining length of zipper along the corresponding edge.

Referring particularly to FIG. 8, the bag 10 may also include one or more interior pockets 78, 80 selectively positioned on the interior surface of the upper portion 14 and sized to hold a heat pack (not shown) in order to provide rapid thermal recovery to a patient suffering from hypothermia. Such heat packs could be any available product that is either heated from an external source or a chemically-reactive product (such as sodium acetate) that generates its own heat. In preferred form, the pockets 78, 80 are attached by sewing or gluing along two opposite transverse edges 79, 81 with intermediate laterally-facing edges 83, 85 releasably secured to hold the heat pack in place. In this manner, a heat pack may be inserted or removed easily from either side of the bag 10. The pockets 78, 80 may be located centrally in the lateral direction and longitudinally to correspond with the position of the torso (at the chest and abdomen) of an average sized patient, as shown in FIGS. 3-6 and 8.

Referring now particularly to FIGS. 4 and 7, the bag 10 may also include a plurality of opposed web handles 82, 84 interconnected by transverse straps 86. These handles 82, 84 and supporting cross straps 86 may be selectively positioned at longitudinal locations 88, 90, 92 to approximately correspond with the position of a typical patient's shoulders, hips and calves. Accordingly, a patient's body is supported in a manner that it will remain in a relatively straight supine position without bending when the bag 10 is used as a litter and carried by handles 82, 84. Also in preferred form, quick release fasteners, such as corresponding VELCRO® strips 94, 96, may be attached to the outer surface of the lower portion 36 and the handles 82, 84 to provide ready access to the handles for use, while making them easy to locate and keeping them free from inadvertent snagging.

If desired a hood or head covering (not shown) may be attached to the bag 10 using transverse strips of VELCRO® attached along the head end 46 edges of the top surface of the outer layer 30 of the upper portion 14 and the bottom surface of the outer layer 36 of the lower portion 12.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What I claim is:

1. A method for using a patient rescue bag, comprising:

providing a patient rescue bag comprising:

(a) a lower portion having a generally rectangular shape with a length and a width, having two longitudinal edges and two transverse edges and having a head area near one of said transverse edges and a foot area near the other of said transverse edges, said lower portion comprising:

(i) an outer surface, wherein said outer surface includes a first portion of a first quick connect/disconnect fastener device that extends proximally to and along said two longitudinal edges;

(ii) an interior surface, wherein said interior surface includes a first portion of a second quick connect/disconnect fastener device that extends proximally to and along said transverse edge near said foot area;

(iii) an inner portion between said outer surface and said interior surface, wherein said inner portion comprises thermal insulative material;

(b) an upper portion having a generally rectangular shape with a length and a width, having two longitudinal edges and two transverse edges and having a head area near one of said transverse edges and a foot area near the other of said transverse edges, wherein the width of the upper portion is greater than the width of the lower portion, said upper portion comprising:

(i) an outer surface;

(ii) an interior surface, wherein said interior surface includes a second portion of said first quick connect/disconnect fastener device that extends proximally to and along said two longitudinal edges and a second portion of said second quick connect/disconnect fastener device that extends proximally to and along said transverse edge near said foot area; and (iii) an inner portion between said outer surface and said interior surface, wherein said inner portion comprises thermal insulative material;

placing a patient within the patient rescue bag such that the patient rests upon the lower portion and the upper portion is above the patient;

folding the longitudinal edges of the upper portion downwardly and inwardly to extend under the longitudinal edges of the lower portion;

attaching the second portion of the first quick connect/disconnect fastener device to the first portion of the first quick connect/disconnect fastener device; and attaching the second portion of the second quick connect/disconnect fastener device to the first portion of the second quick connect/disconnect fastener device.

2. The method of claim 1, wherein said quick connect/disconnect fastener devices include mating hook and loop fastener components.

3. The method of claim 2, wherein the fastener devices extend substantially continuously along each of the corresponding edges.

4. The method of claim 1, wherein the outer surface of the upper portion comprises a water-proof material.

5. The method of claim 1, wherein the patient rescue bag further comprises a removable and replaceable interior liner formed of top and bottom sheets of liquid absorbent material.

6. The method of claim 1, wherein the patient rescue bag further comprises at least two pair of opposite side gripping handles attached to the outer surface of the lower portion, each pair having an interconnecting web of material extending substantially transversely of the bag between opposed handles, each handle positioned laterally inwardly of the first portion of the first quick connect/disconnect fastener device on longitudinal edges of the outer surface of the lower portion.

7. The method of claim 6, wherein the patient rescue bag further comprises a third quick connect/disconnect device wherein each of the handles includes a first portion of the third quick connect/disconnect device and a corresponding second portion is located on the outer surface of the lower portion in a position such that each of the handles may be secured to lie substantially flat against the outer surface and may be selectively disconnected to allow gripping access to the handle.

8. The method of claim 7, wherein the third quick connect/disconnect device includes mating hook and loop fastener components.

9. The method of claim 1, wherein the patient rescue bag further comprises at least one pocket on the interior surface of at least one of the upper and lower portions, and wherein the method of using the patient bag further comprises placing a heat-providing device within at least one pocket to provide heat to the patient.

* * * * *